US010105830B2

(12) United States Patent
McDonald et al.

(10) Patent No.: US 10,105,830 B2
(45) Date of Patent: Oct. 23, 2018

(54) ELECTRONIC CLICK WRENCH

(71) Applicant: Crane Electronics Ltd., Hinckley, Leicestershire (GB)

(72) Inventors: Neil Andrew McDonald, Lichfield (GB); Peter William Everitt, Barwell (GB); Adrian James Duffin, Rugby (GB); Himang Virendra Sharma, Leicester (GB); Daniel Thomas Ahearn, Cambridge (GB); Simon Philip Jelley, Cambridge (GB)

(73) Assignee: Crane Electronics Ltd., Hinckley, Leicestershire (GB)

( * ) Notice: Subject to any disclaimer, the term of this patent is extended or adjusted under 35 U.S.C. 154(b) by 206 days.

(21) Appl. No.: 15/313,874

(22) PCT Filed: Feb. 18, 2015

(86) PCT No.: PCT/GB2015/050473

§ 371 (c)(1),
(2) Date: Nov. 23, 2016

(87) PCT Pub. No.: WO2015/145104

PCT Pub. Date: Oct. 1, 2015

(65) Prior Publication Data

US 2017/0144281 A1 May 25, 2017

(30) Foreign Application Priority Data

Mar. 24, 2014 (GB) ..... 1405254.2

(51) Int. Cl.
*B25B 23/142* (2006.01)

(52) U.S. Cl.
CPC ..... *B25B 23/1427* (2013.01); *B25B 23/1425* (2013.01)

(58) Field of Classification Search
CPC ..... B25B 23/1427; B25B 23/1425
See application file for complete search history.

(56) References Cited

U.S. PATENT DOCUMENTS

| | | | | |
|---|---|---|---|---|
| 2,812,677 | A | 11/1957 | Paterson | |
| 2007/0227316 | A1* | 10/2007 | Lucke | B25B 23/1425 81/478 |
| 2011/0132157 | A1* | 6/2011 | Duvan | B25B 13/462 81/479 |

FOREIGN PATENT DOCUMENTS

| | | | |
|---|---|---|---|
| DE | 10051011 | A1 | 4/2002 |
| TW | 201223716 | A | 6/2012 |

* cited by examiner

*Primary Examiner* — David B Thomas
(74) *Attorney, Agent, or Firm* — Alan G. Towner; Leech Tishman Fuscaldo & Lampl

(57) ABSTRACT

An electronic click wrench comprises a handle for applying torque through a shaft to a working head. The shaft includes torque sensing means for calculating the torque applied to a workpiece by the working head, and a trigger mechanism for sending a haptic feedback to a user by triggering a small movement of the handle relative to the working head when a set point torque is reached. The trigger mechanism comprises a permanent magnet that is normally anchored by magnetic attraction to a pole piece so as to resist separation when a force is applied through the handle, and an electromagnetic means actuable to reduce or cancel that magnetic attraction so as to permit separation of the pole piece and permanent magnet, thus generating the haptic feedback. Operation of the electromagnet may oppose the flux of the permanent magnet through the pole piece. Alternatively operation of the electromagnet may divert the flux of the permanent magnet away from the pole piece.

14 Claims, 5 Drawing Sheets

ELECTRONIC CLICK WRENCH

FIELD OF THE INVENTION

This invention relates to torque wrenches, and provides a torque wrench which combines electronic torque sensing with the haptic feedback of a so-called 'click wrench'.

BACKGROUND OF THE INVENTION

Torque wrenches are known hand tools which are used in manufacturing industry for example on assembly lines to tighten bolts and other threaded fasteners to a recommended minimum tightness. It is increasingly important in production line manufacture to control and monitor the maximum and minimum torque to which threaded fastener joints are tightened. The use of alloys of relatively soft and lightweight metals for components does mean that over-tightening a joint can cause serious damage to the thread of the fastener being tightened or to the component being anchored by the threaded fastener, whereas under-torquing a joint does and always has had serious safety issues.

On a typical production line, an assembly engineer may use a torque wrench that is pre-set to deliver a predetermined amount of torque before the wrench sends a haptic feedback signal to the user to warn that the correct torque level has been applied to the joint. The predetermined amount of torque applied by the wrench to a joint which triggers the haptic feedback signal is known as the set point of the wrench. The most common torque wrenches used in industry are so-called click wrenches. Each wrench comprises a handle and a working head connected together by a shaft. The length of the shaft determines how much torque is applied at the working head by the user imparting a given manual force to the handle. The working head may be a simple rigidly mounted square socket coupling or it may include a ratchet mechanism mounting a square socket coupling. The click mechanism creates the haptic feedback to the user when the desired set point has been reached, which feedback comprises a limited small angular movement between the shaft and the working head which is permitted only when the set point has been reached. The shaft and working head are locked at a constant angle when the applied torque is less than the set point, but when that set point is reached a trigger releases the locking and allows the above small angular movement, generally of only one or two degrees of angle, before again locking the shaft and the working head at a (second) fixed angle for example by abutment of a portion of the shaft against a fixed wall of the working head or vice versa. That sudden movement normally generates a click sound, from which the click wrench takes its name; and the click sound does provide the user with a degree of aural feedback indicating that the set point has been reached, although the much more discernible haptic feedback is the feel of sudden and abruptly terminated small free movement of the handle as the user applies a force to the wrench at the handle end. The user relies on that haptic feedback to tell him or her to cease applying force to the handle end of the wrench. Continued application of force will cause over-tightening of the joint, and the click wrench relies on the skill of the user to release the force on the handle as soon as the haptic feedback is sensed. Current working practices are such that a user may have access to a first click wrench pre-set to deliver a recommended torque of, for example, 40 Newton Meters (Nm) to a first range of joints; a second click wrench pre-set to deliver a recommended torque of, for example, 30 Nm to a second range of joints; and third and further click wrenches set to deliver different recommended torques to other joints on the assembly line. The potential disadvantages of this practice are immediately apparent. The user may pick up the wrong wrench to use on a given joint. Even if that does not happen, each user must be provided with a sufficient number of differently pre-set click wrenches to accommodate all of the joints being fastened; and each of those pre-set wrenches must be maintained at the correct torque setting and regularly calibrated to make sure that the set point does not wander from the intended setting in use. Recalibration of every single click wrench on a weekly basis is not uncommon. Some click wrenches are user-adjustable so that the user may alter the set point against a dial or scale provided on the wrench itself, so that the same click wrench may be used to tighten different joints to different desired torques. That has the advantage that a single click wrench can be used in place of several, but the disadvantage that it relies on the user to remember to reset the set point whenever moving from a joint with one desired torque level to another; and it relies on the user to make that adjustment accurately. As with the non-user-adjustable click wrenches, such adjustable wrenches need to be recalibrated and serviced regularly, to ensure that the set point at which the click mechanism is triggered is accurately reflected on the dial or scale.

A simple mechanical click wrench triggers the haptic feedback indicating that the desired set point has been reached by a trigger mechanism, generally a roller ball which is normally held in a concave seat by a spring, which is purely mechanical and which relies on the compression of the spring to control the desired set point. The spring compression must be checked regularly, to maintain accuracy of the haptic feedback signal.

All such simple mechanical click wrenches have the limitations that (a) they cannot record the actual torque to which a joint has been tightened and (b) they do not monitor the angular movement of the wrench head during tightening.

No simple click wrench can however provide a guarantee that the user has tightened any given joint to its recommended torque value. The user may not respond properly to the haptic feedback and may over-tighten or under-tighten any particular joint. Much greater reliability, and a record of the torques to which a series of joints have been tightened, is provided by electronic torque measurement of the joints being tightened, which is possible using a bending beam and a strain sensor or sensors on that bending beam with a feedback of measured maximum torque being relayed to a computer memory. That enables the computer to monitor the sequence of fasteners being tightened, and by incorporating a sensor which recognises each joint being tightened, to set the desired threshold torque electronically for each joint in turn in the sequence. It has been proposed to insert a separate strain sensor as an additional element in the torque application path between the working head of a mechanical wrench such as a click wrench and the socket which drives the head of the fastener being tightened. Such a separate strain sensor does however incur an additional cost and can be removed and mislaid by the user. It does not create automatic electronic adjustment of the desired set point for any given joint being tightened. The addition of a separate strain sensor between the wrench head and the joint adds to the overall length of the wrench. This has inherent disadvantages. In the first place users do in general prefer smaller and shorter wrenches, which provide better control of torque application and are less susceptible to over-torquing. In addition, the insertion of a separate strain sensor between the wrench head and the joint requires an operator to compensate for the additional torque which a given pulling force will exert at a joint. The user may need to have reference to a look-up table or may perform actual calculations to provide that compensation, and the calculations are in any case predicated on the user pulling the click wrench at a specific point on the handle.

It has also been proposed to incorporate such a strain sensor or sensors into the shaft of a torque wrench as a permanent feature, to display the applied torque on an electronic display on the wrench handle or shaft, and to generate a feedback signal to the user from the resulting electronic torque measurement when the set point is approached or reached. The electronic display is more accurate than the purely mechanical display of the dial or scale of the adjustable mechanical click wrenches discussed above. The most easily generated feedback signals are visual or aural. For example a light or a series of lights on the wrench or on a small monitor adjacent the user can indicate when the desired torque is approached and/or attained, or an audible alarm could sound to indicate the same. Such visual or aural feedback signals are however easily overlooked in a factory environment where there may be background noise and distracting lights, or when the wrench is used at an awkward angle or in a position where the visual display is difficult to see. There has therefore been a need for a mechanism to trigger a haptic feedback in response to an electronic torque measurement within the wrench, so that the benefits of an electronic torque wrench can be combined with the familiarity and ease of use of a click wrench. Although there have been proposals to combine electronic torque sensing and a click mechanism, for example in US-A-2007/0227316 or US-A-2011/0132157, no such electronic click wrench has been offered on the commercial market. The reason is apparently the difficulty of providing a sufficiently sensitive and reliable trigger that is responsive to relatively small trigger forces in a wrench which has a torque path designed to deliver torques much higher than the trigger torques, for example torques of up to several hundreds of Newton Meters. Commercially available electronic wrenches therefore still tend to use visual or aural feedback to the user.

It is an object of the invention to provide an electronic torque wrench which includes a haptic feedback of the click mechanism variety, while maintaining a reliable triggering of the haptic feedback when a desired set point has been sensed by strain sensors in the wrench.

THE INVENTION

The invention provides an electronic click wrench having the features of claim 1 herein. In use a force applied to the handle is transmitted through the shaft to the working head so as to apply a torque to a workpiece through that working head. That force transmission route does however include the permanent magnet and pole piece, and the magnetic attraction between the permanent magnet and pole piece is normally sufficient to prevent separation of the pole piece from the permanent magnet. When the desired set point is reached at the working head of the wrench, as sensed by the torque sensing means, the magnetic means is actuated so as to reduce or cancel the magnetic attraction between the permanent magnet and the pole piece and permit separation of the pole piece from the permanent magnet. That separation provides the haptic feedback to the user that is familiar to all users of click wrenches. Preferably the power requirement to cancel the magnetic attraction is only momentary, for example only a fraction of a second. The force applied by the user is sufficient to move the pole piece rapidly away from the permanent magnet as soon as the attraction force is interrupted. The small power consumption makes the mechanism suitable for a battery-powered device, with the battery being housed for example in the handle of the torque wrench. The wrench automatically resets itself when the pole piece comes back into magnetic attraction distance of the permanent magnet, without the need for further battery power.

The small haptic feedback movement of the handle relative to the working head may be a small rotary movement of the shaft relative to the working head, or a small rotary movement of the handle relative to the shaft. In the former case the permanent magnet may be connected to the working head or shaft and the pole piece may be a part of or may be connected to the shaft or working head. In the latter case the permanent magnet may be connected to the handle or shaft and the pole piece may be a part of or may be connected to the shaft or handle. Preferably the permanent magnet is mounted in and connected to the handle and the pole piece is a part of or connected to the shaft, as there is more space in the handle for housing the permanent magnet. Also the handle may be readily provided with a removable cover or panel for ease of access to the permanent magnet for assembly, servicing and maintenance.

Preferably the wrench is connected to a microprocessor so that the torque sensing means can send to the microprocessor a signal for recording the maximum torque applied to a joint being tightened. Even after separation of the pole piece from the permanent magnet to generate the haptic feedback signal to the user that the set point has been reached, the torque sensing means continues to sense the torque applied at the working head of the wrench, so that when the wrench is used to tighten a series of joints for example on a production line, an audit record can be kept to show the actual maximum torque applied to each joint in turn. The connection to the microprocessor is preferably a wireless connection, although it may be a wired connection or the microprocessor may be incorporated into the wrench making a stand-alone combination. If the working head includes a sensor for recognising each individual one of the series of joints with which the click wrench is to be used, and communicating that information to the microprocessor, feedback from the microprocessor can act to set the set point at which triggering takes place, appropriate for each individual joint with which the click wrench is to be used.

The magnetic means which acts to reduce or cancel the magnetic attraction between the permanent magnet and the pole piece is electromagnetic in nature. A variety of different and alternative electromagnetic coil windings are contemplated.

Preferably the permanent magnet is a bar magnet having opposed pole faces, and the electromagnetic means includes magnetically permeable components in magnetic contact with those opposed pole faces and contoured and positioned to shape and contain the magnetic flux of the permanent magnet. One such component is in magnetic contact with one of the pole faces of the permanent magnet and comprises a magnetically permeable core around which is wound the electromagnetic coil. The other comprises a base plate in magnetic contact with the other of the pole faces of the permanent magnet and a continuous wall surrounding the permanent magnet, the first magnetically permeable component and the electromagnet coil. The end faces of the first and second magnetically permeable components together present a preferably planar seating for the said pole piece for anchoring the pole piece by magnetic attraction between the permanent magnet and the pole piece, and the fact that the continuous wall of the second such component surrounds the permanent magnet, the first magnetically permeable component and the electromagnet coil means that the magnetic flux of the permanent magnet is efficiently contained. This enclosed arrangement is that which provides the best design for controlling and containing the magnetic flux path of both the permanent magnet and the electromagnetic coil; windings, which act when energized to oppose the magnetic field path of the permanent magnet, thereby reducing or cancelling the magnetic attraction between the permanent magnet and the pole piece.

Alternatively if the permanent magnet is substantially U-shaped the one or more electromagnetic coils may comprise one such coil wound around each leg of the permanent magnet such that energization of those electromagnetic coils generates an electromagnetic field which opposes the magnetic field path of the permanent magnet, thereby reducing or cancelling the magnetic attraction between the permanent magnet and the pole piece.

Alternatively, if the permanent magnet is similarly substantially U-shaped, the one or more electromagnetic coils may comprise an electromagnetic winding around a permeable core positioned to create a magnetic flux path between the legs of the permanent magnet, whereby a current in a first direction through the electromagnetic winding reinforces the magnetic attraction between the permanent magnet and the pole piece and a current in the opposite direction through the electromagnetic winding creates a preferred flux path from the permanent magnet through the permeable core, thus reducing or cancelling the magnetic attraction between the permanent magnet and the pole piece.

When the pole piece separates from the permanent magnet it does so without backlash, so that the haptic feedback signal to the user to indicate that the threshold torque has been applied is one that is reliably generated without backlash inaccuracies. The small movement of the handle relative to the working head is not one that is responsive to the set force of a spring, as is the case with conventional click wrenches, so that although calibration checking is advisable, the wrench does not require such regular checks as it is not necessary to correct for the inevitable creep of such springs over time.

The set point at which the haptic feedback is triggered may with advantage be a calculated value as described in our co-pending patent application GB-A-2506705, in which it is described how the threshold trigger may be in advance of a target torque. The rate of change of sensed torque is monitored, and by extrapolation from that monitored rate of change it is predicted when the actual sensed torque will be equal to a torque component of a target condition. A set point is thus calculated which is effective to establish a final actual limit applied by the drive head of the wrench which is close to the target condition, and the haptic feedback is triggered when that set point is sensed. This allows the wrench to compensate for the different rates of pull on the wrench handle by different users, and for different user reaction times.

DRAWINGS

The invention is illustrated by the drawings, of which:

Figure 1:
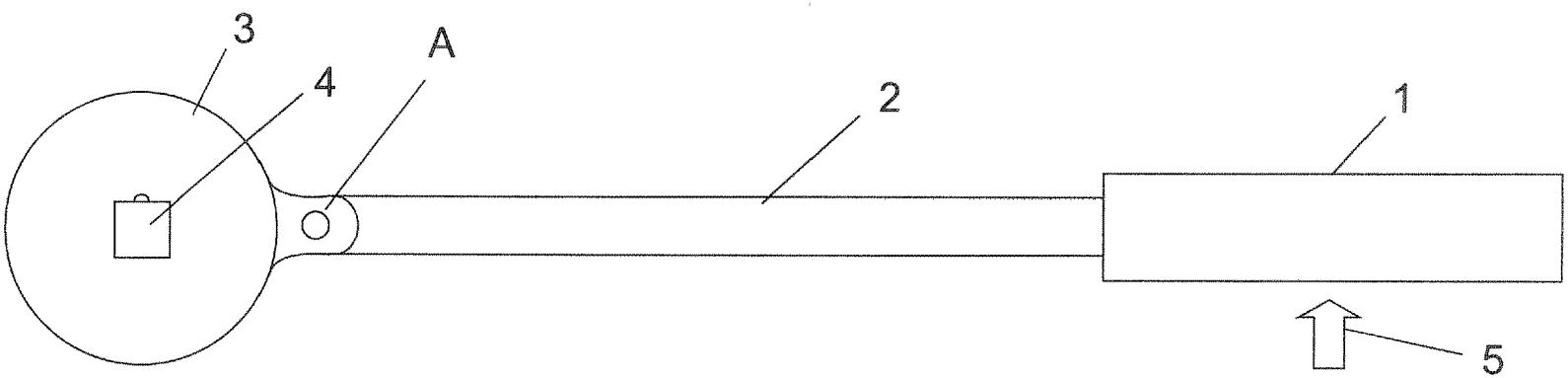
FIG. 1 is an illustration of a conventional click wrench with mechanical click actuation. The view is from the underside or back side of the wrench.
Figure 2:
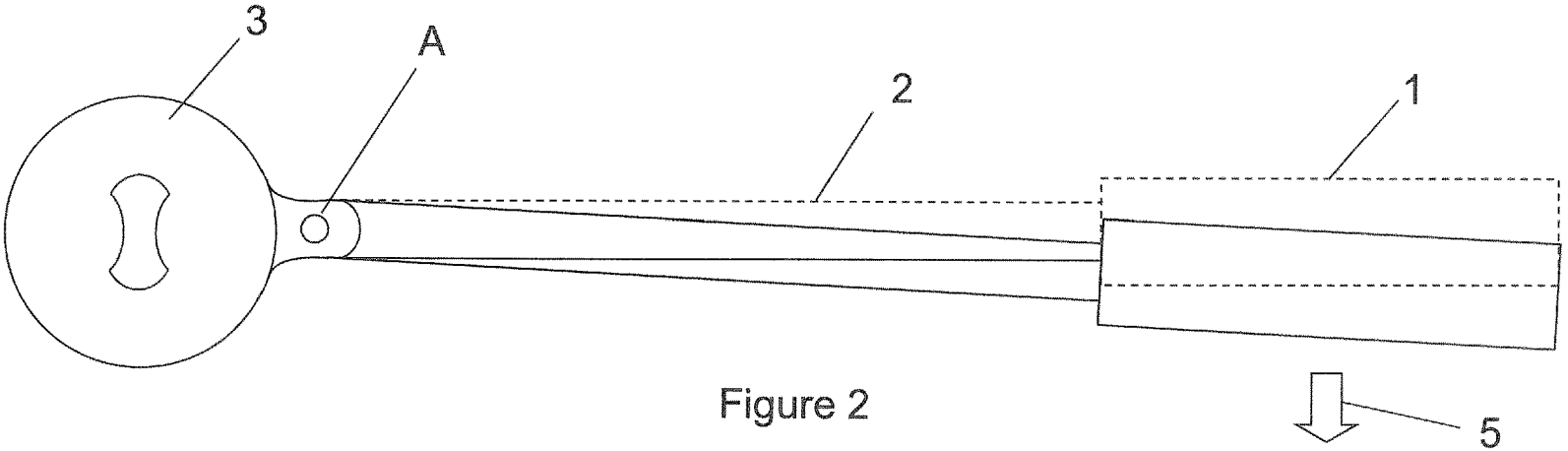
FIG. 2 is an illustration from the top side of the same click wrench as that of FIG. 1, showing the relatively small angular movement after click actuation.

Referring first to FIGS. 1 and 2, there is shown a conventional click wrench viewed from both sides (bottom side and top side respectively). The wrench comprises a handle 1 connected to a working head 3 by a shaft 2. The handle 1 is fast to the shaft 2 but the shaft 2 is pivotally connected to the working head 3 such that it is capable of a small angular movement relative to the working head 3 about a pivot pin A. The normal condition of the click wrench is shown in FIG. 1, and the wrench may be used to tighten a threaded joint by fitting a conventional socket onto the square drive end 4 and placing that socket over the shaped head of the joint fastener (nut or bolt) to be tightened. A force is then applied to the handle 1 in the direction of the arrow 5 of FIG. 1, and a combination of the applied force and the length of the shaft from the handle 1 to the working head 3 generates the applied clockwise torque. When a pre-set threshold torque is applied to the joint, a release mechanism (usually a ball being forced out of a cup against the force of a set spring) causes the pivoting action to take place, and the shaft 2 and handle 1 pivot together about the pin A to the position shown in broken lines in FIG. 2. That in itself is a haptic feedback to the user, who is thus warned to stop applying force to the handle. A further and secondary aural feedback resides in the click sound that is generated when the shaft and handle move to the limiting position shown in FIG. 2, which gives this kind of wrench the name 'click wrench'.

Figure 3:
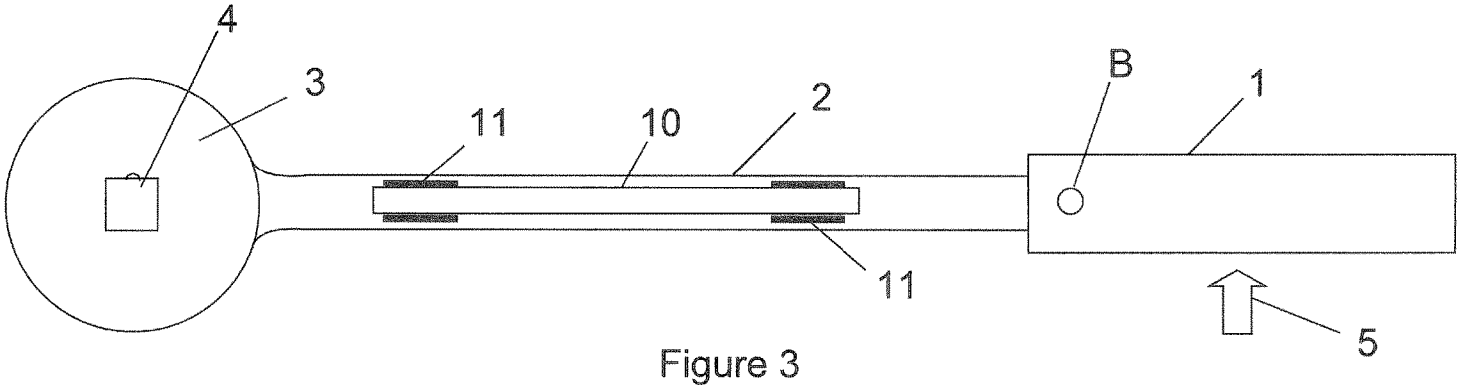
FIGS. 3 and 4 are illustrations, similar to those of FIGS. 1 and 2 respectively, of a click wrench according to the invention.
Figure 4:
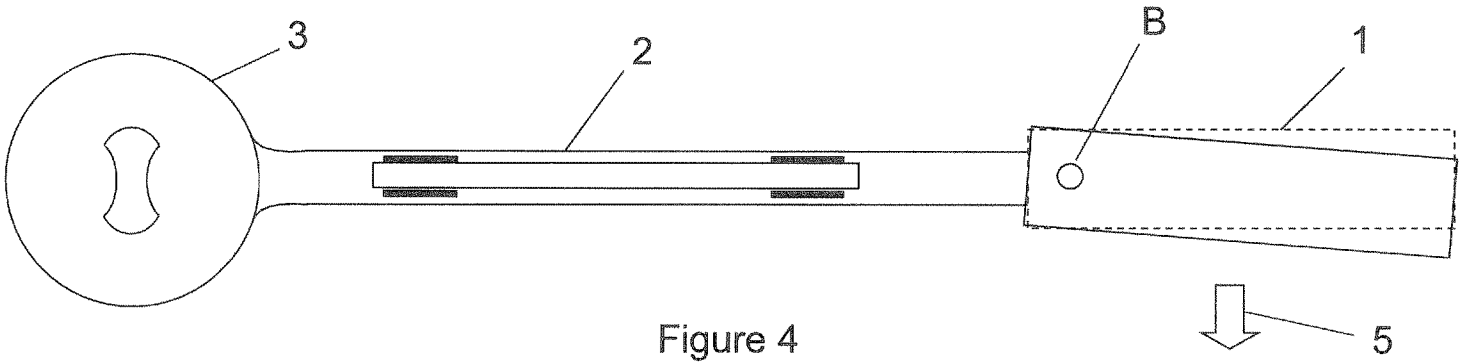

A torque wrench according to the invention is illustrated in FIGS. 3 and 4. Similarities with the click wrench of FIGS. 1 and 2 will be immediately apparent, with the same reference numbers being used for similar components of the wrench. The small pivotal movement when the set point is reached is in FIG. 4 a pivotal movement about the pin B and is an angular movement of the handle 1 relative to the shaft 2. The total feedback to the user is very similar to that of a conventional click wrench, having both haptic and aural components. It is however within the scope of this invention that the small pivotal movement may be about the same pivot pin A as that of FIG. 1. A first important difference between the wrench of the invention and a conventional click wrench as shown in FIGS. 1 and 2 is in the shaft 2 of the wrench of FIGS. 3 and 4 is a bending beam 10 and strain sensors 11, shown only very schematically in the drawings, which together form a torque sensing means which sense the degree of bending of the beam 10 and from that calculate the torque applied at the working head 3. The provision of mutually spaced strain sensors 11 on the bending beam 10 enables the torque sensing means to be made point of load insensitive. The wrench of FIGS. 3 and 4 is thus an electronic wrench which, in common with other known electronic wrenches, can send a torque record signal through a wired or wireless connection to a microprocessor which records the maximum torque applied by the wrench to each fastening which is tightened in a series of fastening operations. This enables a record to be kept for audit purposes of the accuracy of torque values applied in, for example, a production line.

A second important difference between the wrench of the invention and a conventional click wrench is the mechanism for triggering the haptic feedback signal when the threshold applied torque has been reached. The click mechanism is triggered not by a ball being forced out of a cup at the working head end of the wrench but by a magnetic attraction between a permanent magnet and a pole piece which at a given threshold torque is released to trigger the angular movement.

Figure 5:
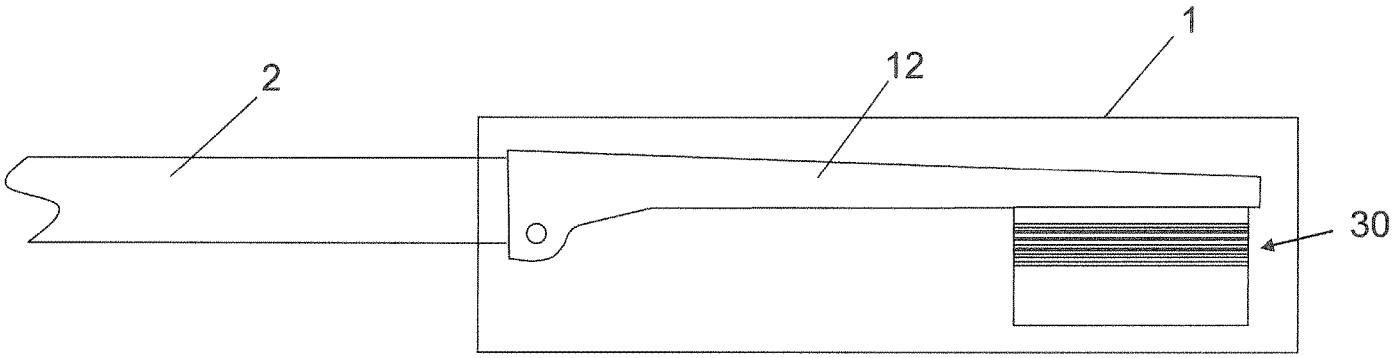
FIGS. 5 and 6 are illustrations of the handle internal components, being a trigger mechanism that may be used in a click wrench according to FIGS. 3 and 4.
Figure 6:
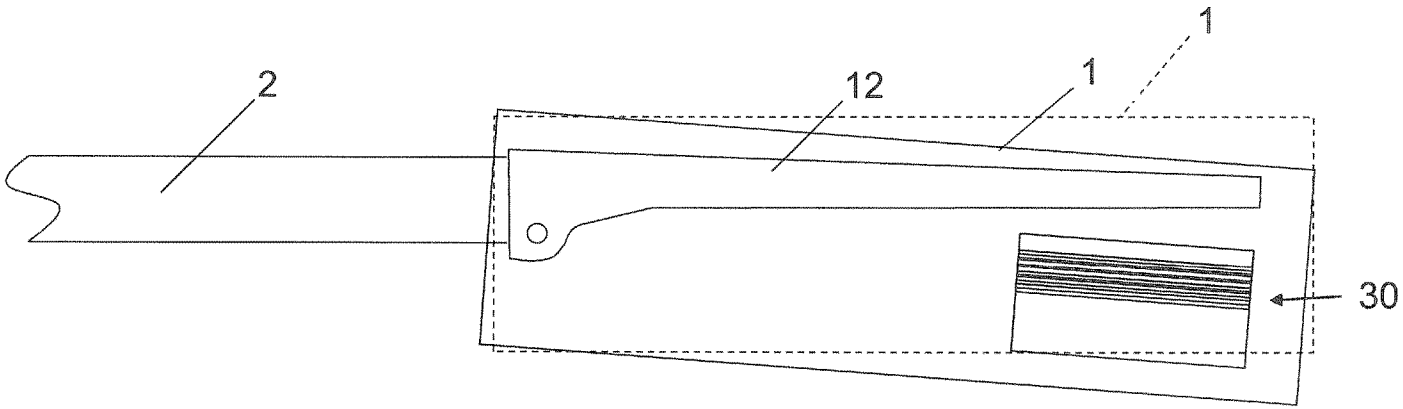
Figure 7:
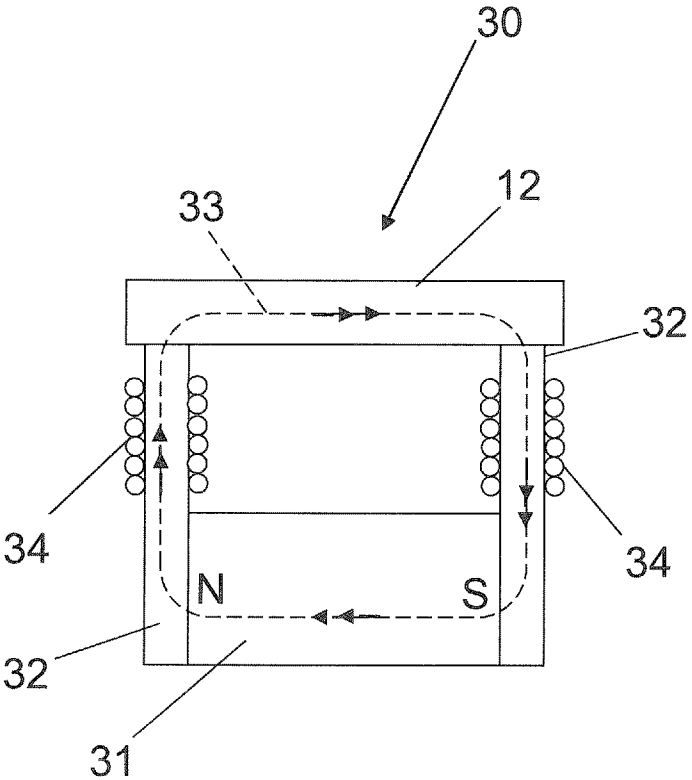
FIG. 7 is a schematic illustration of the switchable magnetic flux path through the permanent magnet and pole piece of the trigger mechanism of FIGS. 5 and 6.

FIGS. 5 to 7 show a first trigger mechanism which may be used in the click wrench of FIGS. 3 and 4 according to the invention. Only the handle end of the wrench is shown in FIGS. 5 and 6. The handle 1 is shown transparently so as to show the main internal components. The necessary trigger mechanism is conveniently housed in the handle 1 which preferably has a removable cover (not shown) to access the trigger mechanism for initial assembly or for subsequent maintenance.

In FIG. 5 the wrench handle 1 is shown in its normal usage condition, before the threshold torque has been applied. In FIG. 6 the condition is shown after the set point has triggered the click mechanism, with the initial handle position being shown for reference in broken line. A spine member 12 is visible in both Figures, as a rigid extension of the shaft 2. The spine member 12 is made of a magnetically permeable material or has a piece of magnetically permeable material affixed to it where it contacts the poles of the magnet assembly, and acts as the pole piece for a magnet assembly 30 secured to the handle 1. It is attracted by the magnet assembly 30 and in normal use is anchored to the handle 1 through a permanent magnet flux component of the magnet assembly 30. Good magnetic attraction is ensured by careful machining of flat surfaces of the magnet assembly 30 and spine member 12 and by ensuring that a large area of each is in contact with the other. Although not shown in the drawings, a floating mounting of the magnet assembly 30 poles or of a contact portion of the spine member 12 can assist in ensuring that there is good physical and therefore magnetic contact.

Although as illustrated and as described above the spine member 12 acts as the pole piece for the magnet assembly 30 which is secured to the handle 1, it will be readily understood that as an alternative the spine member 12 could mount the magnet assembly 30 and the pole piece could be secured to the handle 1. Also, in FIGS. 5 and 6 the magnet assembly is given the reference number 30 which is the magnet assembly more particularly described and illustrated in FIG. 7 but it should be understood that the magnet assembly illustrated in FIGS. 5 and 6 could be the magnet assembly 40 of FIG. 8 or the magnet assembly 50 of FIGS. 9 to 12.

The magnet assembly 30 is better explained with reference to FIG. 7. It is in fact a dual path magnet, comprising both permanent magnet and electromagnet components. A permanent magnet component is a bar magnet 31 which has North and South poles as indicated by the letters N and S, and has attached or integral legs 32 made of magnetically permeable material such as iron or carbon steel to form a substantially U-shaped permanent magnet 31, 32. The legs 32 contact the magnetically permeable spine member 12 as a pole piece, and thus hold the handle magnetically in position against the spine member 12. The magnetic flux path is shown by the broken line arrowed path 33 of FIG. 7. The magnetic attraction is sufficient to resist the separation of the magnet 30 and spine member 12 when a fastener tightening force is applied to the handle 1 in the direction of the arrow 5 of FIG. 8. To trigger the separation and generate the haptic feedback signal to the user when a target torque has been reached, electromagnetic coils 34 are wound around each of the legs 32 and when energised generate an electromagnetic flux in the legs in opposition to the magnetic flux of the permanent magnet 31, 32.

Actuation of the haptic feedback in the torque wrench of FIGS. 3 to 7 is with a minimum of moving parts. In a torque wrench capable of exerting a torque at its working head of up to 250 Nm, the lower forces at the handle 1 enable the handle to be held against separation from the spine member 12 by magnetic attraction alone, until the magnetic attractive forces are removed or reduced by energisation of the electromagnet coils 34. There is no backlash, which is a distinct advantage.

Figure 8:
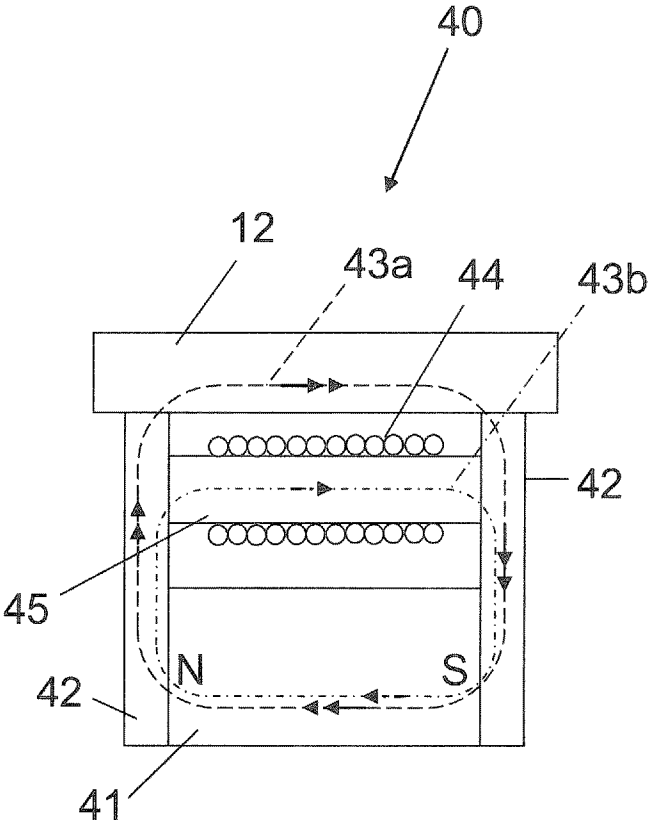
FIG. 8 is a schematic illustration of the alternative magnetic flux paths through an alternative trigger mechanism that may be used in a click wrench according to FIGS. 3 and 4.

Another possible combination 40 of permanent magnet and electromagnet to achieve the same triggering is shown in FIG. 8. In FIG. 8 the permanent magnet is shown as a bar magnet numbered 41 and two magnetically permeable legs 42 form it into a U-shaped permanent magnet 41, 42. Between those legs extends a magnetically permeable bar 45 around which are wrapped turns of an electromagnetic coil 44. Two alternative magnetic flux paths are shown. A first flux path 43*a* is shown in broken lines with double headed arrows, and by suitable selection of the size and magnetic permeability of the bar 45 is the preferred flux path when the electromagnetic coil is not actuated. Indeed it can be made the sole flux path if the electromagnetic coil 44 is energised to oppose the magnetic flux of the permanent magnet 41. It is that flux path 43*a* which causes the magnetic attraction between the magnet 40 and the spine member 12 which acts as pole piece for the magnet. When the triggering of the haptic feedback signal is required, an electric current is sent through the coil 44 to generate a magnetic flux path through the bar 45 and the preferred flux path becomes that shown as path 43*b* in chain-dotted lines with single headed arrows. The magnetic attraction between the magnet 40 and the spine element 12 is thus reduced to such an extent that the force 5 (FIG. 3) is more than sufficient to permit separation of the handle 1 from the spine element 12 with a resulting small rotation of the handle about the pin B.

Figure 9:
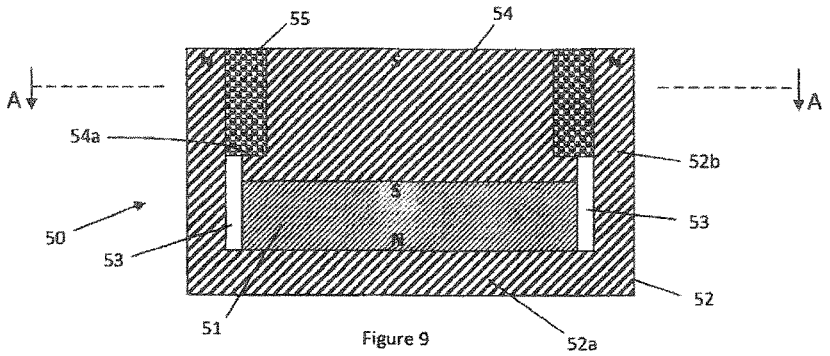
FIG. 9 is a section through an assembly of a permanent magnet and an electromagnet which, together with the pole piece shown in FIGS. 11 and 12, forms the trigger mechanism of a modification of the click wrench of FIGS. 5 and 6, the section of FIG. 9 being taken along the plane B-B of FIG. 10.
Figure 10:
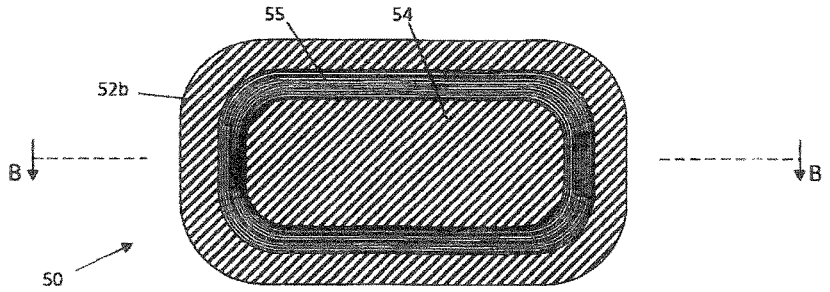
FIG. 10 is a section taken along the plane A-A of FIG. 9.
Figure 11:
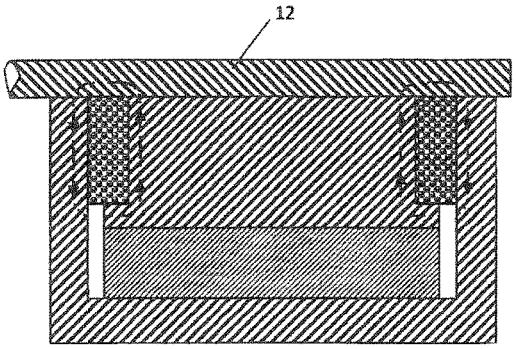
FIGS. 11 and 12 are sections through the magnet assembly of FIG. 9 together with the associated pole piece in its respective positions relative to the magnet assembly before and after triggering of the haptic feedback by energisation of the electromagnet.
Figure 12:
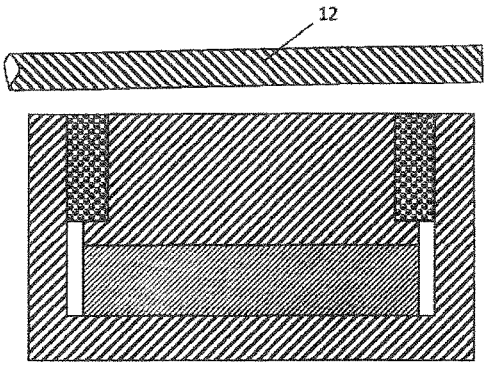

Another, and most preferred, possible combination 50 of permanent magnet and electromagnet to achieve the same triggering is shown in FIGS. 9 to 12. The magnet assembly 50 comprises a permanent magnet 51 located at the bottom of a central recess formed in a magnetically permeable body 52. The body 52 forms one magnetically permeable component of the magnet assembly 50 (the second magnetically permeable component of claim 7) and comprises a base plate portion 52*a* and a continuous upstanding wall portion 52*b* surrounding the permanent magnet 51. The North and South poles of the permanent magnet 51 are shown in FIG. 9 and are on the top and bottom faces of the magnet as illustrated (although clearly those poles could be reversed with the North pole above and the South pole below). Another magnetically permeable component 54 (the first magnetically permeable component of claim 7) sits above the permanent magnet 51, so that a South pole is induced in the top face of that magnetically permeable component 54 and a North pole induced in the annular top edge of the upstanding wall portion 52*b* of the magnetically permeable component 52. A magnetically impermeable gap 53 is formed between the outer edge of the permanent magnet 51 and the upstanding wall portion 52*b*, and may be either an air gap or an insert of magnetically impermeable material as described later. Around the first magnetically permeable component 54 is an electric coil 55 which is normally not energized but which may momentarily be energized resulting in a field path as illustrated in broken lines in FIG. 11. That electromagnetic field cancels or reduces the magnetic force of the permanent magnet 51 for long enough for the pole piece 12 (FIGS. 11 and 12) to be released from its magnetic anchorage on the top faces of the magnetically permeable components 52 and 54, permitting the separation of the pole piece 12 and magnet assembly 50 as illustrated in FIGS. 12 and 6.

The permanent magnet may be a strong magnet of magnetic material or it may be a rare earth magnet, to create an extremely strong magnetic field to attract and hold the pole piece 12 in use. The magnetically permeable components 52 and 54 may be made of any suitable magnetically permeable material, preferably iron or carbon steel. Preferably the cross sectional area of the upstanding wall portion 52*b* of the magnetically permeable component 52 as viewed in FIG. 10 is the same or substantially the same as the cross sectional area of the magnetically permeable component 54, which ensures a uniformity of magnetic flux throughout the magnetic circuit between the permanent magnet, the first and second magnetically permeable components 54 and 52 and the pole piece 12.

A preferred method of assembly of the magnet assembly 50 of FIGS. 9 to 12 is as follows. First a lining member 53 of non-magnetically permeable material such as a hard plastic is dropped into the hollow central recess of the magnetically permeable component 52, and optionally glued in place. Then the permanent magnet 51 is placed in the centre of the lining member 53. Its magnetism causes it to attract firmly to the base plate portion 52*a* of the component 52, although for additional security and stability it may be preferable for a thin film of epoxy adhesive to be applied to the bottom of the permanent magnet 51 and the top of the base plate portion 52*a*. If it is desired to have the non-magnetically permeably space 53 to be an air gap as opposed to an insert, then the hard plastic lining member may be avoided although it is then necessary to take care that the permanent magnet 51 is centrally located on the base plate portion 52*a*, with a constant spacing between the outer edge of the permanent magnet 51 and the upstanding wall 52*b* of the magnetically permeable component 52. In such an assembly the use of adhesive to fix the permanent magnet 51 in position is more important than if a hard plastic lining member 53 is used.

The electric coil 55 may be pre-wound onto a thin walled former (not illustrated) and placed around the top periphery of the magnetically permeable component 54 resting on an outer shoulder 54*a* thereof (see FIG. 9) preferably before but optionally after the magnetically permeable component 54 is lowered onto the top face of the permanent magnet 51. As with the initial assembly of the permanent magnet 51 and the magnetically permeable component 52, magnetic attraction causes an immediate firm contact between the permanent magnet and the magnetically permeable component 54, although the assembly may be made more secure and robust by adding adhesive or potting compound between the components immediately before or after assembly in order to secure the components together and fill any voids. If the top face of the electric coil 55 is marginally below that of the first and second magnetically permeable components 54 and 52, then it is a preferred practice to machine the top faces of those two magnetically permeable components to a true planar common surface before use (without damage to the coil 55), to ensure the best possible magnetic attraction to the pole piece 12 as shown in FIG. 11.

The pole piece 12 of FIGS. 11 and 12 is the right hand end of the spine member 12 of FIGS. 3 to 6, and FIG. 11 shows the pole piece 12 firmly secured to the magnet assembly 50 during the normal use of the torque wrench when tightening a fastener such as a bolt, as shown in FIGS. 3 and 5. The magnetic attraction between the magnet assembly 50 and the pole piece 12 is sufficient to resist separation of those two components when the tightening force is applied in the direction of the arrow 5. When the strain gauges 11 and associated torque sensing means of the torque wrench sense that the set point has been reached, the electric coil is energized to create a magnetic field as illustrated in broken arrow lines in FIG. 11, which opposes the magnetic attraction between the permanent magnet 51 and the pole piece 12 and permits separation of the previously magnetically attracted faces. The energization of the electric coil 55 may be no more than momentary: less than one second for example. The separation of the pole piece and the magnet assembly is immediate. That separation, under the influence of the user's tightening force applied to the handle of the torque wrench, is illustrated in FIG. 12 and causes the small angular movement of the handle 1 relative to the wrench head 3. The small angular movement generates the haptic feedback to the user to indicate that the set point in torque application has been attained. There is no backlash associated with sliding moving parts in the trigger mechanism, and no pre-tensioned spring members associated with the trigger release. The wrench resets automatically as soon as the user releases the applied torque. The handle returns to its original rotary position relative to the working head 3 and is immediately held in place once again by magnetic attraction between the magnet assembly 50 and the pole piece 12. The trigger mechanism therefore operates reliably with the minimum of moving parts. The surrounding of the permanent magnet by the outer upstanding wall 52*b* of the magnetically permeable component 52 creates a closed path for the magnetic flux of the permanent magnet 51, which makes the construction particularly suitable for installation in the handle of the torque wrench where it is well shielded from magnetic interference with the electronic components which sense the applied torque and communicate with a computer monitoring the progress of a series of tightening operations.

It will be understood that the magnetic trigger mechanisms of FIG. 7 or FIG. 8 or FIGS. 9 to 12 can be used to trigger a haptic feedback to the user by rotation of the handle 1 relative to the shaft 2 about pin B as shown in FIGS. 3 and 4 or by rotation of the handle 1 and shaft 2 relative to the working head 3 about pin A as shown in FIGS. 1 and 2. If movement about pin A were desired, the spine member 12 would be an integral extension of the working head 3 rather than of the shaft 2 and the magnet 30 or 40 or 50 would be attached to the shaft 2 rather than to the handle 1.

All of the advantages discussed above for a wrench according to the invention are attained with wrenches as illustrated in the drawings. A wired or wireless connection to a microprocessor enables an audit record to be kept of the maximum torque exerted by the wrench when used to tighten a series of joints for example in a production line working environment. A sensor (not illustrated) at the working head end preferably permits the microprocessor to identify each joint in turn being tightened, and through a look-up table enables the microprocessor to dictate the set point at which triggering takes place, as appropriate for the joint being tightened. There are no set springs contributing to the trigger actuation, and there is therefore little tendency for the torque trigger to creep away from its microprocessor controlled set point over time. There is in addition a further safeguard and advantage over conventional click wrenches. Even if the sensed applied torque does not trigger the separation of the pole piece from the permanent magnet at the intended set point, there is a finite limit to the magnetic attraction between the magnet and pole piece. When that limit is exceeded, the same separation will take place so that the wrench of the invention does provide a haptic feedback signal to the user even if the electronic signalling is absent. That can avoid or limit damage to the wrench or to the workpiece if there is a failure of the torque sensor means within the wrench or a failure of the computer feedback to set the set point at the intended level.

The wrenches of the invention as illustrated in FIGS. 3 to 12 preferably have batteries in the handle 1 to power the electromagnetic coils 34 or 44 or 55 to release the magnetic attraction between the permanent magnet 31, 32 or 41, 42 or 52,54 and the pole piece 12, but an alternative would be a wire or cable to an external power source. Battery power is generally sufficient because only a short pulse is needed through the coil 34 or 44 or 55 to trigger the separation between the magnet and pole piece, with the click mechanism being self-setting when that pulse is terminated.

The invention claimed is:

1. An electronic click wrench comprising a handle for applying torque through a shaft to a working head, wherein the shaft includes torque sensing means comprising a bending beam and one or more strain sensors for calculating the torque applied to a workpiece by the working head, and a trigger mechanism for sending a haptic feedback to a user by triggering a small movement of the handle relative to the working head when a set point is sensed by the torque sensing means, wherein the trigger mechanism comprises:

a permanent magnet which is normally anchored by magnetic attraction to a magnetically permeable pole piece so as to resist separation of the pole piece and permanent magnet when a force is applied through the handle, permanent magnet and pole piece to induce a fastener-tightening torque at the working head; and electromagnetic means actuable to reduce or cancel that magnetic attraction so as to permit separation of the pole piece and permanent magnet when the set point is sensed by the torque sensing means, such separation of the pole piece and permanent magnet resulting in the small movement of the handle relative to the working head.

2. An electronic click wrench according to claim 1, wherein the small movement of the handle relative to the working head is a small rotary movement of the handle relative to the shaft.

3. An electronic click wrench according to claim 2, wherein the permanent magnet is carried by the handle or shaft, and the pole piece is carried by the shaft or handle.

4. An electronic click wrench according to claim 3, wherein the permanent magnet is carried by the handle and the pole piece is carried by the shaft.

5. An electronic click wrench according to claim 1, wherein the small movement of the handle relative to the working head is a small rotary movement of the shaft relative to the working head.

6. An electronic click wrench according to claim 5, wherein the permanent magnet is carried by the working head or shaft, and the pole piece is carried by the shaft or working head.

7. An electronic click wrench according to claim 1, wherein:

the permanent magnet is a flat bar magnet having opposite pole faces, and the said electromagnetic means comprises an electromagnet coil and first and second magnetically permeable components, of which the first magnetically permeable component is in magnetic contact with one of the pole faces of the permanent magnet and comprises a magnetically permeable core around which is wound the said electromagnet coil, and the second magnetically permeable component comprises a base plate in magnetic contact with the other of the pole faces of the permanent magnet and a continuous wall surrounding the permanent magnet, the first magnetically permeable component and the electromagnet coil, end faces of the first and second magnetically permeable components together presenting a seating for the said pole piece for anchoring the pole piece by magnetic attraction between the permanent magnet and the pole piece;

wherein energization of the electromagnet coil generates an electromagnetic field which opposes the magnetic field path of the permanent magnet, thereby reducing or cancelling the magnetic attraction between the permanent magnet and the pole piece.

8. An electronic click wrench according to claim 7, wherein the end face of the core of the electromagnetic means and the end face of the continuous wall surrounding the permanent magnet, the first magnetically permeable component and the electromagnet coil are coplanar to provide a planar seating surface for the said pole piece.

9. An electronic click wrench according to claim 1, wherein the permanent magnet is a substantially U-shaped structure and the said electromagnetic means comprises one or more electromagnetic coils wound around each leg of the substantially U-shaped structure such that energization of that electromagnetic coil or those electromagnetic coils generates an electromagnetic field which opposes the magnetic field path of the permanent magnet, thereby reducing or cancelling the magnetic attraction between the permanent magnet and the pole piece.

10. An electronic click wrench according to claim 1, wherein the permanent magnet is a substantially U-shaped structure and the said electromagnetic means comprise an electromagnetic winding around a permeable core positioned to create a magnetic flux path between the legs of the substantially U-shaped structure, whereby a current in a first direction through the electromagnetic winding reinforces the magnetic attraction between the permanent magnet and the pole piece and a current in the opposite direction through the electromagnetic winding creates a preferred flux path from the permanent magnet through the permeable core, thus reducing or cancelling the magnetic attraction between the permanent magnet and the pole piece.

11. An electronic click wrench according to claim 1, wherein the permanent magnet or the pole piece is mounted with a small degree of freedom of movement so that in its anchoring condition the pole piece is accurately seated on the permanent magnet.

12. An electronic click wrench according to claim 1, wherein the wrench incorporates or is connectable to a microprocessor for recording the maximum torque applied to a series of joints.

13. An electronic click wrench according to claim 12, wherein the connection to the microprocessor is a wireless connection.

14. An electronic click wrench according to claim 12, wherein the working head includes a sensor for recognizing each individual one of the series of joints with which the click wrench is to be used, and communicating that information to the microprocessor; and feedback from the microprocessor acts to set the set point at which triggering takes place, appropriate for each individual joint with which the click wrench is to be used.

* * * * *